US007497669B2

(12) United States Patent
Ito et al.

(10) Patent No.: US 7,497,669 B2
(45) Date of Patent: Mar. 3, 2009

(54) WESCO TYPE FUEL PUMP

(75) Inventors: Toshihide Ito, Kakuda (JP); Toshihiro Arai, Kakuda (JP); Michiru Fukuda, Kakuda (JP)

(73) Assignee: Keihin Corporation, Tokyo (JP)

( * ) Notice: Subject to any disclaimer, the term of this patent is extended or adjusted under 35 U.S.C. 154(b) by 508 days.

(21) Appl. No.: 10/490,713

(22) PCT Filed: Nov. 20, 2002

(86) PCT No.: PCT/JP02/12120

§ 371 (c)(1),
(2), (4) Date: Mar. 25, 2004

(87) PCT Pub. No.: WO03/044356

PCT Pub. Date: May 30, 2003

(65) Prior Publication Data

US 2004/0247467 A1 Dec. 9, 2004

(30) Foreign Application Priority Data

Nov. 20, 2001 (JP) ..... 2001-354449

(51) Int. Cl.
*F04B 39/06* (2006.01)
*F01D 1/12* (2006.01)

(52) U.S. Cl. ..... 417/366; 415/55.1

(58) Field of Classification Search ..... 417/366, 417/423.1; 415/55.1
See application file for complete search history.

(56) References Cited

U.S. PATENT DOCUMENTS

| | | | | |
|---|---|---|---|---|
| 5,009,575 | A * | 4/1991 | Hanai et al. | 417/244 |
| 6,336,788 | B1 | 1/2002 | Fujii et al. | |
| 6,394,774 | B1 | 5/2002 | Kuehn et al. | |

FOREIGN PATENT DOCUMENTS

| | | |
|---|---|---|
| JP | 7-55130 | 3/1995 |
| JP | 2000329085 A * | 11/2000 |
| JP | 2002-134942 | 5/2002 |
| JP | 2002-227660 | 8/2002 |

* cited by examiner

*Primary Examiner*—Charles G Freay
(74) *Attorney, Agent, or Firm*—R. Neil Sudol; Henry D. Coleman; William J. Sapone

(57) ABSTRACT

To make a Wesco type fuel pump to supply pressure-increased fuel toward a fuel injection valve with no time delay at a time of restarting an engine, an impeller (8) which is rotated by an electric motor (M) arranged within a motor chamber (9) is arranged within a pump chamber (7), a fuel inflow passage (6) which communicates with the outside and a discharge hole (5) which communicates with the motor chamber (9) are open to the pump chamber (7), and the discharge hole (5) is provided with a fuel holding function which inhibits air from flowing into the motor chamber (9) from the pump chamber (7) at a time when the engine stops.

1 Claim, 4 Drawing Sheets

WESCO TYPE FUEL PUMP

TECHNICAL FIELD OF THE INVENTION

The present invention relates to a fuel pump mounted on a motor vehicle, a motor cycle and the like, and more particularly to a Wesco type fuel pump which deliver fuel by generating a pressure difference between the front and the rear of a blade groove provided in an outer periphery of an impeller arranged within a pump chamber by rotation of the impeller by means of an electric motor, and increasing pressure of the fuel by continuously increasing the pressure difference.

TECHNICAL BACKGROUND OF THE INVENTION

A conventional Wesco type fuel pump is shown in Japanese Unexamined Patent Publication No. 7-197896.

In accordance with this structure, the Wesco type fuel pump (herein after, simply referred to as a fuel pump) is constituted by a pump portion and an electric motor.

A pump housing and a pump cover opposingly connected with the pump housing are arranged in a lower side of a housing formed in a cylindrical shape, and these elements are arranged fixedly in a lower side of the housing.

The cylindrical pump chamber is formed by a closed-end circular recess portion which is provided in the pump housing and has an open lower side, and a pump cover flat portion which closes the circular recess portion. A fuel inflow passage being open downward and a discharge hole being open toward the inside of a motor chamber formed within the housing are formed in the pump chamber. An impeller corresponding to a turbine vane formed in a disc shape is rotatably arranged within the pump chamber, a plurality of blade grooves communicating the top and back sides of the impeller are provided in an outer peripheral portion of the impeller, the impeller is connected to a rotating shaft of the electric motor arranged within the motor chamber, and the impeller rotates within the pump chamber on the basis of the rotation of the electric motor.

Further, a fuel flow passage which faces to the blade grooves of the impeller, is open to the inside of the pump chamber and is in a circular arc shape is provided in a depressed shape in a lower surface of the pump housing forming the pump chamber, and the discharge hole is provided so as to be open to the fuel flow passage in a terminal end portion in a rotational direction of the impeller. On the other hand, a fuel flow passage which faces to the blade grooves of the impeller, is open to the inside of the pump chamber and is in the circular arc shape is provided in a depressed shape in an upper surface of the pump cover forming the pump chamber, and the fuel inflow passage is provided so as to be open to the fuel flow passage in a starting end portion in the rotational direction of the impeller.

In accordance with the fuel pump mentioned above, an electric current is applied to the electric motor and the electric motor is rotated, whereby the impeller rotates within the pump chamber, and a pressure difference is generated between the front and the rear of the blade groove of the impeller. The fuel is sucked into the pump chamber including the fuel flow passage through the fuel inflow passage by repeating the action mentioned above by means of a lot of blade grooves, and the pressure increased fuel is discharged from the pump chamber into the motor chamber via the discharge hole.

Further, the pressure increased fuel supplied within the motor chamber opens a check valve within the fuel discharge passage being open to the upper portion of the housing on the basis of the fuel pressure, and is supplied toward an external fuel injection valve.

On the other hand, in the Wesco type fuel pump mentioned above, there is provided with an air bleeding hole for preventing a vapor lock within the pump chamber, and this structure is disclosed in Japanese Unexamined Patent Publication No. 9-209864.

In this case, an upper side of the air bleeding hole is formed so as to be open to the pump chamber via the fuel flow passage provided in the pump cover, and a lower side thereof is provided so as to be open outward from the pump cover.

Accordingly, a vapor generated within the pump chamber is discharged out of the pump chamber via the air bleeding hole together with the pressure increased fuel (corresponding to only a small part of the fuel) within the pump chamber, and it is possible to prevent the vapor lock from being generated within the pump chamber.

In accordance with the conventional Wesco type fuel pump mentioned above, in the case that the fuel pump is arranged within the fuel tank, and a fuel liquid surface formed within the fuel tank is lower than an opening of the fuel inflow passage formed in the pump cover, the following problems are generated.

In the case that the fuel pump is stopped in accordance with an engine stop in the state mentioned above, the check valve within the fuel discharge passage provided in the upper portion of the housing automatically closes the fuel discharge passage on the basis of a disappearance of the fuel pressure applied outward, and prevents the fuel within the downstream side of the fuel pipe than the check valve from flowing back toward the inside of the fuel pump.

On the other hand, in the state mentioned above, the fuel liquid surface within the fuel tank exists at a lower position than the lower opening of the fuel inflow passage and the lower opening of the air bleeding hole, whereby the air existing above the fuel liquid surface flows into the pump chamber from the air bleeding hole, and the fuel existing within the pump chamber is discharged into the fuel tank via the fuel inflow passage. Further, the air flowing into the pump chamber in the manner mentioned above flows into the motor chamber via the blade grooves of the impeller, the fuel flow passage of the pump housing and the discharge hole, the air is replaced by the fuel within the motor chamber gradually, and the fuel within the motor chamber is discharged into the fuel tank via the discharge hole, the pump chamber and the fuel inflow passage.

In accordance with the structure mentioned above, there is a risk that the motor chamber becomes empty without fuel in accordance with a passage of time after the engine stops.

Further, in the case that the engine starting operation is again carried out and the fuel pump is driven, in the state of no fuel within the motor chamber, the fuel discharged from the pump chamber via the discharge hole first fills up the motor chamber with the fuel so as to increase the pressure, and is thereafter supplied toward the fuel injection valve from the fuel discharge passage.

A remarkable matter here is that a volumetric capacity of the motor chamber is far larger than a volumetric capacity of the pump chamber. In other words, the motor chamber having the larger volumetric capacity is first filled with the fuel upon restarting the engine, long time is required until the fuel pressure within the motor chamber is increased, and the fuel supply to the fuel injection valve is delayed, so that there is a risk that an good restarting property of the engine is hampered.

Further, in the case that the fuel pump is arranged within the various fuel tanks, the fuel pump may be arranged in all directions such as in a vertical direction, a diagonal direction and a horizontal direction in view of a layout of the fuel pump. Therefore, differences occur in an air inflow into the pump chamber from the air bleeding hole according to the various arrangement states mentioned above, residual fuel within the pump chamber is uneven, and it is impossible to obtain a stable engine restarting property.

On the other hand, in accordance with Japanese Unexamined Patent Publication No. 2001-27160, there is disclosed a structure in which the check valve is arranged in the discharge hole, and the pressure within the motor chamber is held at a time when the fuel pump is stopped. However, in accordance with this structure, the number of parts and assembling man-hours are increased, whereby it is impossible to reduce a manufacturing cost, and it is hard to design the arrangement of the check valve with in an arrow discharge hole.

SUMMARY OF THE INVENTION

A Wesco type fuel pump in accordance with the present invention is made by taking the problems mentioned above into consideration, and a main object of the present invention is to provide a Wesco type fuel pump which can immediately supply fuel pressured increasedly by a fuel pump toward a fuel injection valve particularly upon restarting an engine after stopping the engine, and can obtain an improved and stable engine restarting property.

In order to achieve the object mentioned above, in accordance with a first aspect of the present invention, there is provided a Wesco type fuel pump comprising:

a pump chamber which is formed of a pump housing and a pump cover covering the pump housing;

an impeller which is rotatably arranged within the pump chamber, is rotated by an electric motor within the motor chamber, and is provided with a plurality of blade grooves communicating the top and back sides in an outer periphery thereof; and a discharge hole which has a fuel flow passage provided in a depressed shape in a peripheral direction along the blade grooves of the impeller on a lower surface facing to the pump chamber of the pump housing, and is formed in a terminal end portion in a rotational direction of the impeller so as to communicate the pump chamber with the motor chamber, wherein the discharge hole is provided with a fuel holding function of inhibiting air from flowing into the motor chamber from the pump chamber on the basis of surface tension of the fuel, at a time when the fuel pump is stopped.

Further, in accordance with a second aspect of the present invention, in addition to the first aspect mentioned above, the discharge hole is open in the lower surface of the pump housing with a step portion facing to the pump chamber.

Further, in accordance with a third aspect of the present invention, in addition to the first aspect mentioned above, an opening area of the discharge hole is made smaller toward the front side in a rotational direction of the impeller.

Further, in accordance with a fourth aspect of the present invention, in addition to the second aspect mentioned above, the step portion is formed in a similar shape to the discharge hole.

In accordance with the first aspect of the present invention, in a state in which the fuel within the pump chamber is discharged to the outside via the fuel inflow passage and the air is flowed into the pump chamber, at a time when the fuel pump is stopped in accordance with the engine stop, a fuel film serving as the fuel holding function caused by the surface tension of the fuel within the motor chamber is formed in the opening end portion to the pump chamber corresponding to the ambient air side of the discharge hole.

In accordance with the structure, since the inflow of the air which is going to move toward the inside of the motor chamber from the inside of the pump chamber is inhibited by the fuel film formed by the surface tension, the replacing operation between the air and the fuel within the motor chamber does not occur, the fuel within the motor chamber is not discharged into the fuel tank via the discharge hole, the pump chamber and the fuel inflow passage, and it is possible to reserve and hold the fuel within the motor chamber. Accordingly, no delay is caused in the fuel supply toward the fuel injection valve at a time of restarting the engine, and it is possible to obtain an improved engine restarting property.

Further, in accordance with the second aspect of the present invention, since the lower end of the discharge hole is open in the lower surface of the pump housing with the step portion, the fuel film is not brought into contact with the impeller arranged within the pump chamber even in the case that the fuel film is formed by the surface tension in the lower end of the discharge hole so as to be curved downward. Accordingly, it is possible to securely form the fuel film.

Further, in accordance with the third aspect of the present invention, since the opening area of the discharge hole is formed narrower toward the front side in the rotational direction of the impeller, the fuel film is formed from the narrower portion, so that it is possible to securely form the fuel film.

Further, in accordance with the fourth aspect of the present invention, since the step portion is formed in the similar shape to the discharge hole, it is possible to make the step portion compact.

DETAILED DESCRIPTION OF PREFERRED EMBODIMENT

Figure 1:
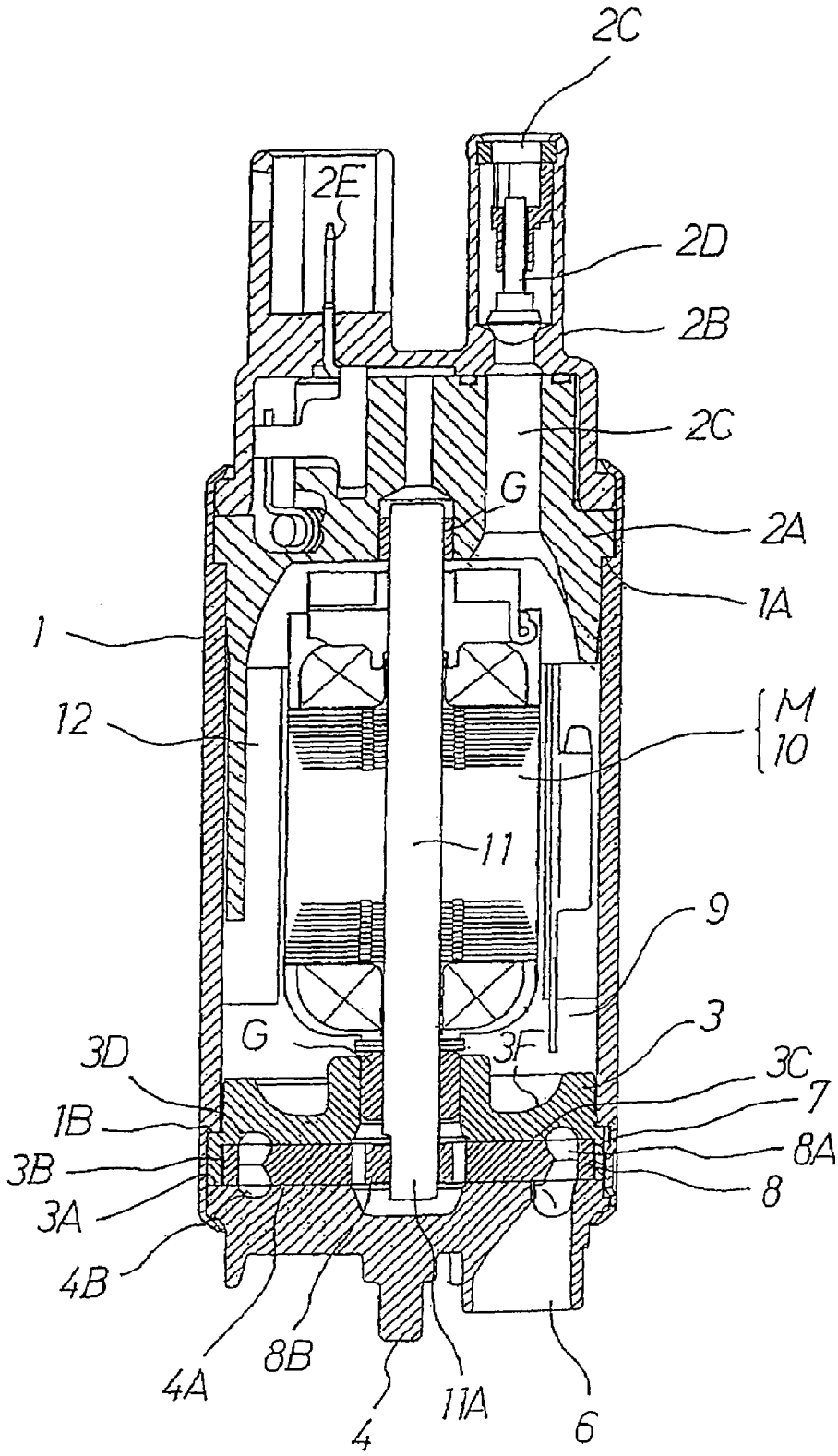
FIG. 1 is a vertical cross sectional view of a Wesco type fuel pump in accordance with the present invention.

A description will be given below of an embodiment of a Wesco type fuel pump in accordance with the present invention with reference to FIG. 1.

Reference numeral 1 denotes a tubular housing which is open in upper and lower sides. The upper opening is closed by a first closing member 2A and a second closing member 2B.

Specifically, the first closing member 2A and the second closing member 2B are arranged so as to be brought into contact on an upper locking step portion 1A of the housing 1, and an upper end of the housing 1 is caulked inward toward a shoulder portion of the second closing member 2B. Further, a fuel discharge passage 2C, in which a lower end is open to the inside of the housing 1 and an upper end is open upward, is formed in the first and second closing members 2A and 2B, and a pressure response type check valve 2D which opens the fuel discharge passage on the basis of the fuel pressure applied upward from the lower side is arranged in the fuel discharge passage 2C.

Further, a bearing G which rotatably supports an upper end of an electric motor mentioned below is arranged in the center of the first closing member 2A, and a power source connector 2E for feeding a power to an armature of the electric motor from the external is provided in the second closing member 2B.

Further, the lower opening of the housing 1 is closed by a pump housing 3 and a pump cover 4.

Figure 2:
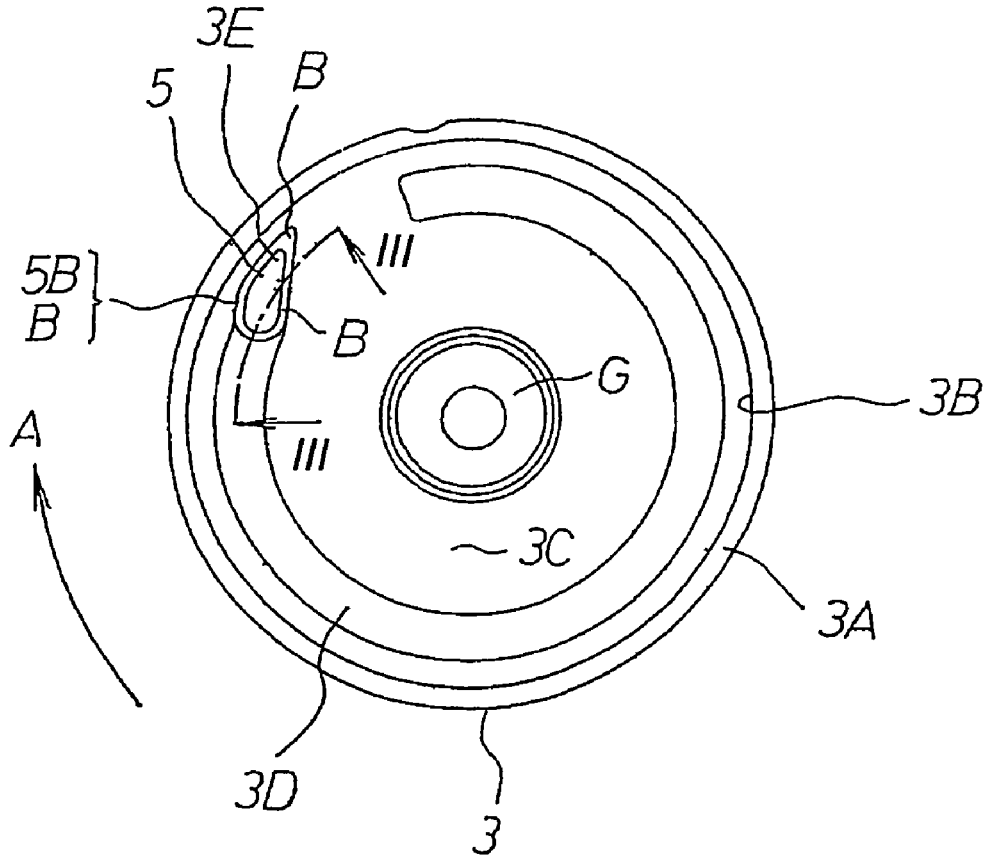
FIG. 2 is a plan view of a pump housing used in FIG. 1 as seen from the lower side.

The pump housing 3 is well shown in FIG. 2, and is described with using FIG. 1 together.

The pump housing 3 is formed in a solid cylindrical shape, and is structured such that a circular recess portion 3B is provided upward from a lower end 3A, and the bearing G is arranged within a through hole in a center portion thereof.

Further, a circular arc fuel flow passage 3D is provided in a depressed shape in a lower surface 3C of the recess portion, and a discharge hole 5 is provided through in a terminal end portion 3E of the fuel flow passage 3D in a rotational direction A of the impeller mentioned below so as to penetrate from the lower surface 3C side toward an upper surface 3F.

Figure 3:
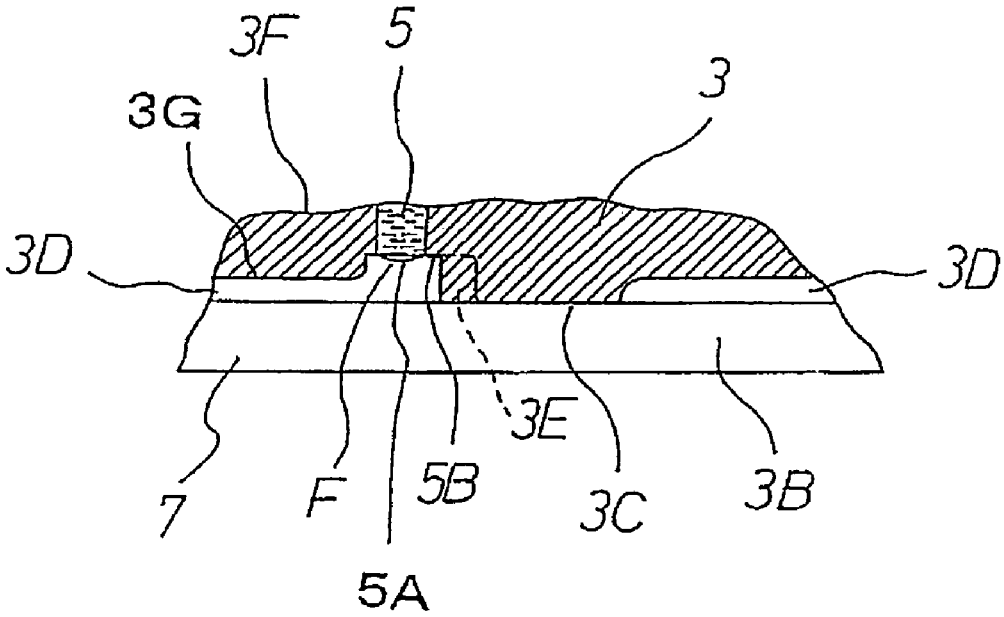
FIG. 3 is a vertical cross sectional view of a main portion along a line III-III in FIG. 2.

The discharge hole 5 is well shown in FIG. 3.

Figure 4:
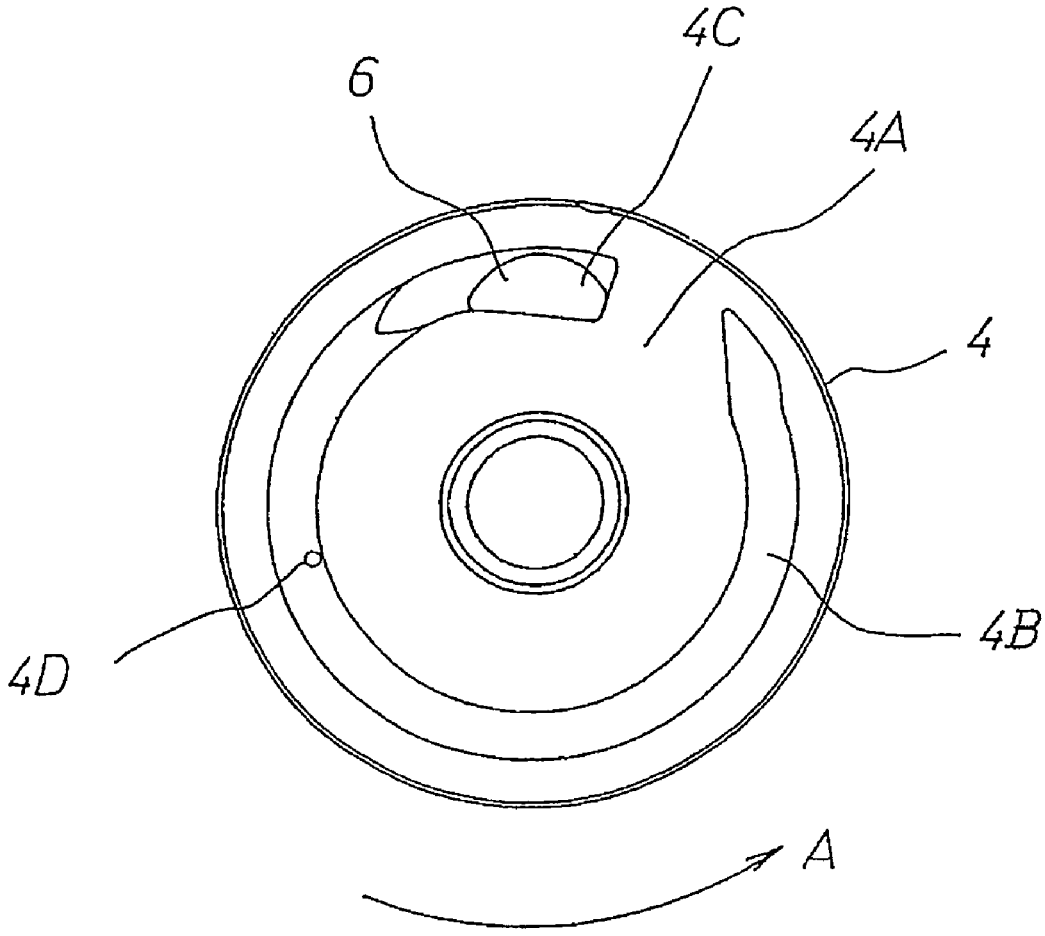
FIG. 4 is a plan view of a pump cover used in FIG. 1 as seen from the upper side.

The pump cover 4 is well shown in FIG. 4, and is described with using FIG. 1 together.

The pump cover 4 is formed in a solid cylindrical shape, and has a flat surface 4A, which is brought into contact with the lower end 3A of the pump housing 3 so as to close the opening of the recess portion 3B, in an upper portion thereof. A fuel flow passage 4B opposing to the fuel flow passage 3D of the pump housing 3 is provided in a depressed shape in the flat surface 4A, and a fuel inflow passage 6 open toward the outside of the pump cover 4 is provided in a starting end portion 4C of the fuel flow passage 4B in the rotational direction A of the impeller mentioned below.

Further, reference symbol 4D denotes an air bleeding hole open toward the outside of the pump cover 4 from the fuel flow passage 4B.

In this case, FIG. 2 is a plan view of the pump housing 3 arranged in the manner shown in FIG. 1 as seen from the lower side, FIG. 3 is a vertical cross sectional view of a main portion along a line III-III in FIG. 2, and FIG. 4 is a plan view of the pump cover 4 arranged in the manner shown in FIG. 1 as seen from the upper side.

Further, the pump housing 3 is arranged so as to be brought into contact with the lower locking step portion 1B of the housing 1, and the flat surface 4A of the pump cover 4 is arranged so as to be brought into contact with the lower end 3A of the pump housing 3, and the lower end of the housing 1 is caulked inward toward the shoulder portion of the pump cover 4 in this state, whereby the pump housing 3 and the pump cover 4 are arranged so as to be fixed to the lower end of the housing 1.

In accordance with the structure mentioned above, the circular recess portion 3B of the pump housing 3 is closed by the flat surface 4A of the pump cover 4 so as to form the pump chamber 7, and the impeller 8 is rotatably arranged within the pump chamber 7.

The impeller 8 is provided with a plurality of blade grooves 8A which communicate the top and back sides of the impeller 8 and face to the fuel flow passage 3D of the pump housing 3 and the fuel flow passage 4B of the pump cover 4, on an outer periphery thereof, and a segmental hole 8B formed in a D shape is provided through in the center thereof.

On the other hand, a motor chamber 9 is formed within the housing 1 between the first closing member 2A and the pump housing 3, and an electric motor M is arranged within the motor chamber 9.

The electric motor M is constituted by an armature 10, a rotating shaft 11 fixedly provided through the center of the armature 10, and a pair of permanent magnets 12 facing to an outer periphery of the armature 10.

Further, an upper end of the rotating shaft 11 is rotatably supported to the bearing G of the first closing member 2A, a lower side of the rotating shaft 11 is rotatably supported to the bearing G of the pump housing 3, and the D-cut portion 11A in a lower end of the rotating shaft 11 is inserted to the segmental hole 8B of the impeller 8 so as to be engaged.

Accordingly, when the electric power is fed to the armature 10 via a connector 2E and the electric motor M is rotated, the impeller 8 is synchronously rotated by a rotating force applied from the rotating shaft 11. The fuel is sucked into the pump chamber 7 from the fuel inflow passage 6 in accordance with the rotation of the impeller 8 within the pump chamber 7. The fuel pressured increasedly within the pump chamber 7 is supplied into the motor chamber 9 via the discharge hole 5, and the fuel within the motor chamber 9 is supplied toward an external fuel injection valve (not shown) via the fuel discharge passage 2C.

In this case, in accordance with the fuel pump of the present invention, the discharge hole 5 is provided with the fuel holding function obtained by the fuel film caused by the surface tension of the fuel at a time when the fuel pump is stopped.

In other words, when the fuel pump is stopped, the fuel remaining within the pump chamber 7 is discharged to the external from the fuel inflow passage 6 by the air flowing into the pump chamber 7 from the air bleeding hole 4D, and the pump chamber 7 becomes empty.

Paying attention to the discharge hole 5 in the state mentioned above, the lower end 5A of the discharge hole 5 is open so as to face to the pump chamber 7 in which no fuel but air exists, and on the other hand, the fuel continuous with that in the motor chamber 9 exists in the discharge hole 5, whereby the fuel film F serving as the fuel holding function applied by the surface tension of the fuel is formed in the lower end 5A of the discharge hole 5. This structure can be understood by FIG. 3.

Further, since the fuel film F serving as the fuel holding function is formed in the discharge hole 5, the air existing within the pump chamber 7 can not flow into the motor chamber 9 via the discharge hole 5 due to the resistance of the fuel film F, and the replacing operation between the air and the fuel within the motor chamber 9 is not carried out. Accordingly, the fuel reserving within the motor chamber 9 is inhibited from being discharged to the outside via the discharge hole 5, the pump chamber 7 and the fuel inflow passage 6.

In this case, it is necessary that the discharge hole 5 secures a desired pump discharge amount in addition to the fuel holding function mentioned above. For example, a fuel pump for a compact car of about 660 cc engine displacement requires a pump discharge amount of 60 L/H. In the case of using the impeller 8 having a diameter of 33.6 mm, a thickness of 3.8 mm, and forty six blade grooves 8A, in the fuel pump, the fuel holding function caused by the surface tension of the fuel, and the desired pump discharge amount can be obtained by setting a transverse cross sectional area of the discharge hole 5 to be 7.884 $mm^2$.

In this case, the numeric values mentioned above are only for one embodiment, and the discharge hole can be set appropriately in view of both sides so as to have both the pump discharge amount, and the fuel holding function achieved by the fuel film formed by the surface tension of the fuel.

As mentioned above, since the fuel film F serving as the fuel holding function is formed in the discharge hole 5, at a time of stopping the fuel pump, the fuel within the motor chamber 9 does not flow out to the external even at a time when the engine is stopped, and it is possible to continuously reserve and hold the fuel within the motor chamber 9. Accordingly, in the case that the electric motor M is driven at the time of restarting the engine from the engine stop state mentioned above, it is possible to supply the fuel which is continuously reserved within the motor chamber 9, toward the fuel injection valve (not shown) via the fuel discharge passage 2C, as soon as the pump chamber 7 having a far small volumetric capacity is filled with the fuel, so that it is possible to restart the engine with no time delay.

Further, the fuel film F formed in the discharge hole 5 is not changed even in the case that the arrangement state of the fuel pump is changed. It is possible to always reserve and hold the fuel within the motor chamber 9 at a time when the fuel pump is stopped, without relation to the arrangement state of the fuel pump.

Accordingly, it is possible to always restart the engine with no time delay, without relation to the arrangement state of the fuel pump.

Further, in accordance with the present invention, since the fuel film F formed in the discharge hole provided in the fuel pump is utilized as the fuel holding function, it is not necessary to use new parts.

Accordingly, it is unnecessary to increase the number of the parts and the number of the assembling man-hour, it is unnecessary to check to warrant a durability caused by increasing the constituting parts, it is extremely easy to apply to the conventional fuel pump and it is possible to inhibit a manufacturing cost from being increased.

Further, the lower end 5A of the discharge hole 5 is open to the lower surface 3C of the pump housing 3 with the step portion 5B expanded sideward, and the impeller 8 arranged within the pump chamber 7 is not brought into contact with the fuel film F at a time when the fuel film F is formed in the lower end 5A of the discharge hole 5 due to the surface tension of the fuel, whereby it is possible to more securely form the fuel film F.

In the present embodiment, the step portion 5B is provided to be depressed in the upper side from the upper portion 3G of the fuel flow passage 3D in the housing 3, and this structure is clearly shown in FIG. 3.

In brief, the step portion 5B performs the function of preventing the fuel film F formed in the lower end 5A of the discharge hole 5 from being in contact with the other members.

Further, in the case that the opening area of the discharge hole is made smaller toward the front side in the rotational direction A (a clockwise rotational direction in FIG. 2) of the impeller 8, it is possible to further securely form the fuel film F.

The opening area of the discharge hole 5 is formed tapered toward the front side in the rotational direction A in FIG. 2, the fuel film F caused by the surface tension of the fuel is first formed in the leading end portion of the tapered discharge hole 5, and the fuel film F is formed by growing toward the rear end portion of the discharge hole 5. In other words, the fuel film F formed at an early stage in the leading end portion of the tapered discharge hole 5 is immediately expanded like as rippling all over the discharge hole 5.

Further, in the case that the step portion 5B mentioned above is formed in the similar shape to the shape of the discharge hole 5, an approximately even escape portion B can be formed for the fuel film F formed in the lower end 5A of the discharge hole 5, so that it is possible to further securely inhibit the impeller 8 from being brought into contact with the fuel film, and it is effective to form and hold the fuel film F. As shown in FIG. 2, the step portion 5B surrounds the discharge hole 5 and has an outer boundary or perimeter (not separately designated) formed in a shape geometrically similar to the shape of the discharge hole 5 so that the step portion 5B has a substantially uniform width all around the discharge hole 5.

Further, in accordance with the structure mentioned above, it is possible to form a cast pin corresponding to the discharge hole 5 in a similar shape to a cast pin corresponding to the step portion 5B, at a time of forming the pump cover 4 in accordance with an injection molding, so that it is possible to easily manufacture the cast pins.

As mentioned above, in accordance with the Wesco type fuel pump of the present invention, since the fuel holding function for inhibiting the air from flowing into the motor chamber from the pump chamber due to the surface tension of the fuel at a time when the fuel pump is stopped, is provided in the discharge hole provided in the pump housing which communicates the pump chamber with the motor chamber, the fuel reserved within the motor chamber is not discharged into the fuel tank through the fuel inflow passage on the basis of the fuel film which is formed in the discharge hole by the surface tension of the fuel and has the fuel holding function, at a time when the engine is stopped and the fuel pump is stopped, even in the case that the fuel pump is arranged within the fuel tank, and the fuel liquid surface within the fuel tank is lower than the opening of the fuel inflow passage formed in the pump cover.

Accordingly, it is possible to immediately restart the engine with no time delay at a time of restarting the engine, and it is possible to stably restart the engine even in the different arrangement states of the fuel pump.

Further, since the discharge hole itself is provided with the fuel holding function, it is possible to inhibit the manufacturing cost from being increased without requiring any specific new parts, and it is possible to extremely easily apply to the conventional fuel pump.

Further, in the case that the lower end of the discharge hole is open to the lower side of the pump housing with the step portion, the fuel film formed in the lower end of the discharge hole is not broken by the other members, and it is possible to stably form and maintain the fuel film.

Further, in the case that the opening area of the discharge hole is formed smaller toward the front side in the rotational direction of the impeller, it is possible to immediately and securely form the fuel film in the lower end of the discharge hole.

Further, in the case that the step portion formed in the lower end of the discharge hole is formed in the similar shape to the shape of the discharge hole, it is possible to form the even escape portion with respect to the lower end of the discharge hole, it is possible to securely form and hold the fuel film, and it is possible to inexpensively form the step portion.

What is claimed is:

1. A fuel pump comprising:

a pump chamber which is formed of a pump housing and a pump cover covering the pump housing;

an impeller which is rotatably arranged within the pump chamber, is rotated by an electric motor within a motor chamber, and is provided with a plurality of blade grooves communicating the top and back sides in an outer periphery thereof; and a discharge hole which has a fuel flow passage provided in a depressed shape in a peripheral direction along the blade grooves of the impeller on a lower surface facing the pump chamber of the pump housing, and is formed in a terminal end portion in a rotational direction of the impeller so as to communicate the pump chamber with the motor chamber, wherein an opening area of said discharge hole is made smaller toward a front side in a rotational direction of the impeller, said discharge hole is open to a lower surface of the pump housing via a step portion facing the pump chamber, the step portion surrounds said discharge hole and has an outer boundary or perimeter formed in a shape geometrically similar to the shape of the discharge hole so that the step portion has a substantially uniform width all around said discharge hole, and the flow of air from the pump chamber to the motor chamber is inhibited by formation of a fuel film due to surface tension of fuel at a lower end of the discharge hole, at a time when the fuel pump is stopped.

* * * * *